US009970436B2

(12) United States Patent
Navarro et al.

(10) Patent No.: US 9,970,436 B2
(45) Date of Patent: May 15, 2018

(54) PULSATION-FREE POSITIVE DISPLACEMENT ROTARY PUMP

(71) Applicant: SWISSINNOV PRODUCT SARL, Gland (CH)

(72) Inventors: Thierry Navarro, Gland (CH); Florent Junod, Veigy Foncenex (FR)

(73) Assignee: SWISSINNOV PRODUCT SARL, Gland (CH)

( * ) Notice: Subject to any disclaimer, the term of this patent is extended or adjusted under 35 U.S.C. 154(b) by 0 days. days.

(21) Appl. No.: 14/403,117

(22) PCT Filed: May 2, 2013

(86) PCT No.: PCT/IB2013/000819
§ 371 (c)(1),
(2) Date: Nov. 21, 2014

(87) PCT Pub. No.: WO2013/175277
PCT Pub. Date: Nov. 28, 2013

(65) Prior Publication Data

US 2015/0147210 A1 May 28, 2015

Related U.S. Application Data

(63) Continuation-in-part of application No. PCT/IB2012/001003, filed on May 23, 2012, and a
(Continued)

(51) Int. Cl.
*F04B 53/00* (2006.01)
*F04B 1/047* (2006.01)
(Continued)

(52) U.S. Cl.
CPC ..... *F04B 53/006* (2013.01); *F04B 1/02* (2013.01); *F04B 1/047* (2013.01); *F04B 1/1071* (2013.01); *F04B 1/1072* (2013.01); *F04B 9/047* (2013.01)

(58) Field of Classification Search
CPC ..... F04B 53/006; F04B 1/02; F04B 1/047; F04B 1/1071; F04B 9/047; F04B 1/1072;
(Continued)

(56) References Cited

U.S. PATENT DOCUMENTS 1,776,843 A 9/1930 Schafer
1,936,614 A 11/1933 Ballman
(Continued)

FOREIGN PATENT DOCUMENTS

CN 101048594 10/2007
CN 101131152 2/2008
(Continued)

OTHER PUBLICATIONS

International Search Report for PCT/IB2013/000819, English translation attached to original, Both completed by the European Patent Office on Jul. 24, 2013, All together 7 Pages.

*Primary Examiner* — Essama Omgba
*Assistant Examiner* — Stephen Mick
(74) *Attorney, Agent, or Firm* — Brooks Kushman P.C.

(57) ABSTRACT

A pump having two pistons placed in a rotor, situated in a stator forming two opposite parallel eccentric pumping chambers having at least one inlet port through which the fluid is drawn into at least one of the pumping chambers during the filling movement of at least one of the pistons and, subsequently, expelled from at least one of the pumping chambers, during the emptying movement of at least one of the pistons, to at least one outlet port, characterized by an inlet cavity in connection with the inlet port, an outlet cavity
(Continued)

in connection with the outlet port and two port changeover transition zones situated between each side of the cavities.

15 Claims, 15 Drawing Sheets

Related U.S. Application Data continuation-in-part of application No. PCT/IB2012/002451, filed on Nov. 23, 2012.

(51) Int. Cl.
*F04B 1/107* (2006.01)
*F04B 9/04* (2006.01)
*F04B 1/02* (2006.01)

(58) Field of Classification Search
CPC ... F04B 1/1047; F04B 7/0023; F04B 11/0066
USPC ..... 417/533
See application file for complete search history.

(56) References Cited

U.S. PATENT DOCUMENTS

| | | | | |
|---|---|---|---|---|
| 4,177,771 | A | 12/1979 | Nutku | |
| 5,145,339 | A * | 9/1992 | Lehrke | F04B 1/02 417/430 |
| 5,993,174 | A * | 11/1999 | Konishi | F04B 43/00 417/413.1 |
| 7,421,986 | B2 | 9/2008 | Yakhnis | |
| 2007/0290450 | A1* | 12/2007 | Uhrner | F16J 15/3476 277/399 |
| 2010/0101534 | A1* | 4/2010 | Yu | F03C 1/047 123/45 R |
| 2011/0283878 | A1 | 11/2011 | Romanin | |
| 2012/0265128 | A1* | 10/2012 | Kolln | A61M 5/14216 604/67 |

FOREIGN PATENT DOCUMENTS

| | | |
|---|---|---|
| CN | 101852089 | 10/2010 |
| GB | 2014648 | 8/1979 |
| JP | H08177511 | 7/1996 |

* cited by examiner

SECTION ON C-C

SECTION ON D-D

Section A-A

Section B-B

SECTION B-B

SECTION C-C

SECTION D-D

SECTION E-E

SECTION F-F

SECTION G-G

SECTION A-A

SECTION D-D

SECTION E-E

SECTION F-F

PULSATION-FREE POSITIVE DISPLACEMENT ROTARY PUMP

CROSS-REFERENCE TO RELATED APPLICATION

This application is the U.S. national phase of PCT Application No. PCT/IB2013/000819 filed on May 2, 2013, which claims the benefit of PCT/IB2012/001003 application filed May 23, 2012 and PCT/IB2012/002451 application filed on Nov. 23, 2012, the disclosures of which are incorporated in their entirety by reference herein.

The invention concerns a preferably pulsation-free positive displacement pump consisting of two rotary pistons for the precise distribution at variable flow rate of liquids, medication, foods, detergents, cosmetic products, chemical compounds or any other type of fluid, gel or gas.

PRIOR ART

There exist different motors and systems employing rotary pistons such as are described in U.S. Pat. Nos. 1,776,843, 4,177,771 and 7,421,986 the operating principle of which consists in driving a rotor containing two parallel eccentric pistons and cylinders in opposition by combustion of the fuel contained in the cylinders.

In U.S. Pat. No. 1,776,843 the pistons are guided by bearings fixed to the ends of the pistons sliding along a cam placed along the interior wall of the stator and a second cam connected to the stator on the rotor side. The to-and-fro movement of the pistons is produced by the movement of the bearings along the two cams.

In U.S. Pat. No. 4,177,771 the pistons are guided by bearings fixed to the ends of the pistons sliding along the stator having an oblong shape. The pistons therefore move radially when the rotor turns. The to-and-fro movement of the pistons can be produced only by coupling two pairs of parallel pistons fixed to the rotor with each pair offset 180° relative to the other pair and eccentric relative to the rotation axis of the rotor so that the movement compressing the gases in one pair of pistons occurs at the time of the explosion of the gases in the other pair.

In U.S. Pat. No. 7,421,986 the pistons are guided by means of a circular cam on the stator in which the drive shafts of the links connected to the pistons slide. The to-and-fro movement of the pistons is produced by the eccentricity of the rotation axis of the rotor relative to the axis of the stator.

Although these systems can potentially be adapted to function as pumping systems, a first problem encountered with these systems is that they comprise numerous parts, which makes their manufacturing and maintenance costs high for use in a medical or food environment, for example, where they must be cleaned or sterilized.

The second problem is that the principle of spring-loaded valves employed for the distributor by these systems is unsuitable for the production of pumping systems using injection-molded plastic parts that normally employ elastomer seals.

The third problem is that these systems have a discontinuous alternating operating cycle that cannot produce a pulsation-free flow if they are used as pumping systems.

A fourth problem that is encountered is that these systems cannot be made from injection-molded plastic parts to produce pumps employing low-cost disposable fluidic modules that can be discarded after use.

DESCRIPTION OF THE INVENTION

The present invention concerns a high-performance pump comprising a small number of parts produced at very low cost for pulsation-free pumping and metering of liquids, viscous products or gases at variable flow rates.

This invention solves the problems described above and enables simplified development for the mass production of pumps with an element in contact with the pumped fluid that is interchangeable and preferably made of disposable low-cost plastic.

The pump comprises two opposite parallel pistons placed in two cylindrical cavities of a rotor turning in a cylindrical stator with at least one inlet port and at least one outlet port having on its interior face a piston guide cam and preferably a housing for a sealing element positioned between the rotor and the stator.

The pumping principle consists in turning the rotor placed inside the stator so as to move the pistons axially in the rotor via the cam located on the interior wall of the stator. The cam is dimensioned with six segments, a short nominal filling segment, two short segments for draining at a flow rate lower than the nominal flow rate of the pump, a long segment for draining at the nominal flow rate of the pump and two segments for changeover of the valves between the inlet and outlet ports of each pumping chamber. During the phase of draining one chamber at the nominal flow rate of the pump the other chamber changes over from the outlet port to the inlet port and is then filled completely and changes over from the inlet port to the outlet port, after which the two chambers discharge to the outlet port, preferably simultaneously, at low flow rates the sum of which is equivalent to the nominal flow rate of the pump so that the outlet flow rate is preferably stable, continuous, uninterrupted and pulsation-free.

In order to produce a high-performance seal with a minimum of components the system for changing over the connections of the inlet and outlet ports to the pumping chambers is adapted to be synchronous with the movement of the pistons without requiring any additional elements.

The drive arrangement of the pump principally consists of a support, a drive head and an actuator, preferably in the form of a motor. The pump is particularly well suited to production at low cost given that it is formed only of parts that are easy to injection mold in plastic and to assemble automatically.

DESCRIPTION OF THE DRAWINGS

The present invention will be better understood after reading the description of examples given by way of non-limiting illustration only with reference to the appended drawings, in which.

Third Variant

Figure 21:
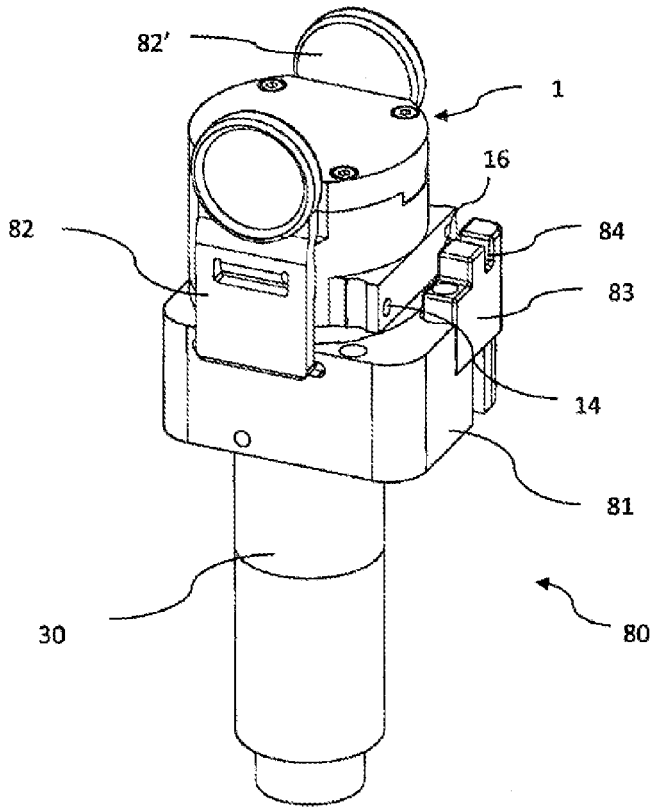
Figure 22:
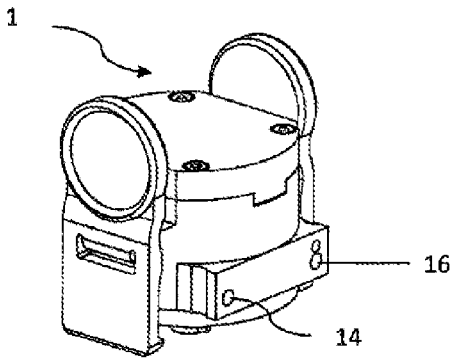
Figure 23:
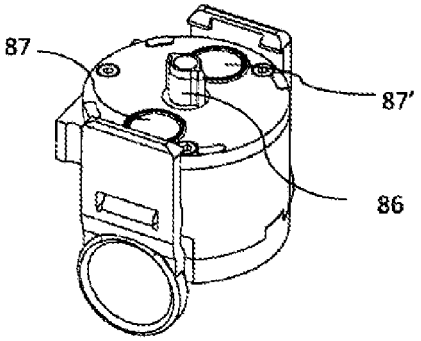
Figure 24:
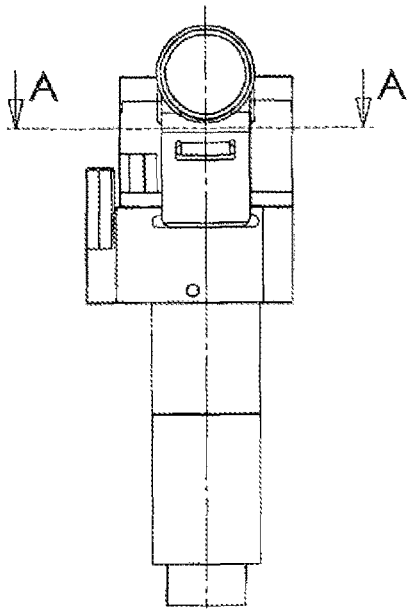
Figure 25:
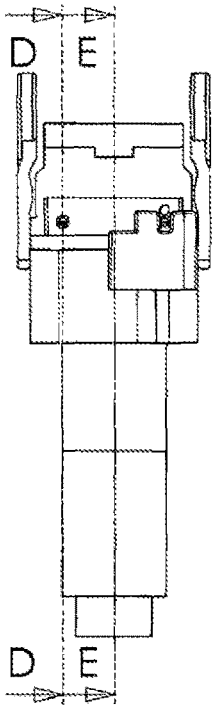
Figure 26:
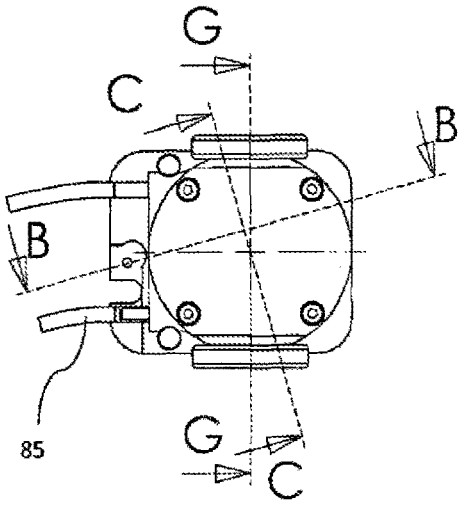
Figure 27:
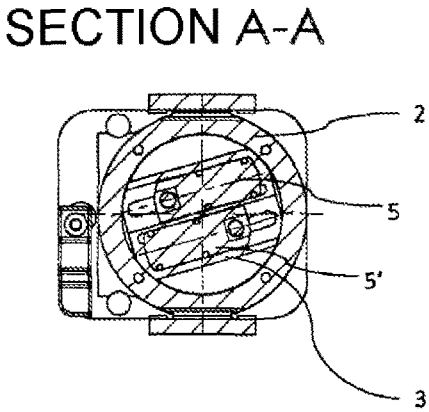

FIG. 21 is a view of an assembly of the third variant of the invention with drive arrangement and motor FIG. 22 is a perspective top view of the invention FIG. 23 is a perspective bottom view of the invention FIG. 24 is a side view of the assembly FIG. 25 is a front view of the assembly FIG. 26 is a top view of the assembly FIG. 27 is a longitudinal section taken along the line A-A according to FIG. 24

Figure 28:
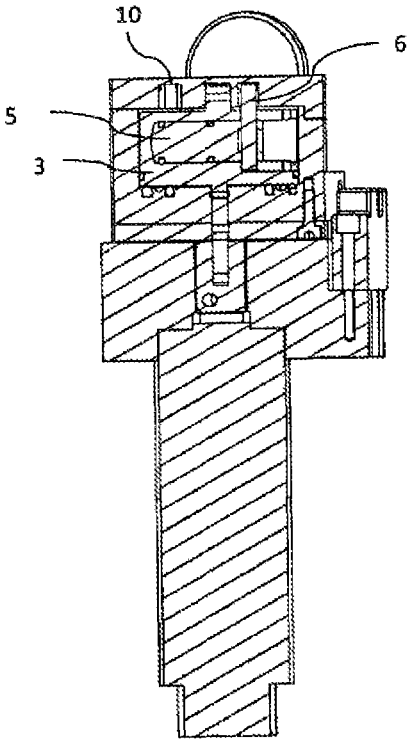

FIG. 28 is a longitudinal section taken along the line B-B according to FIG. 26

Figure 29:
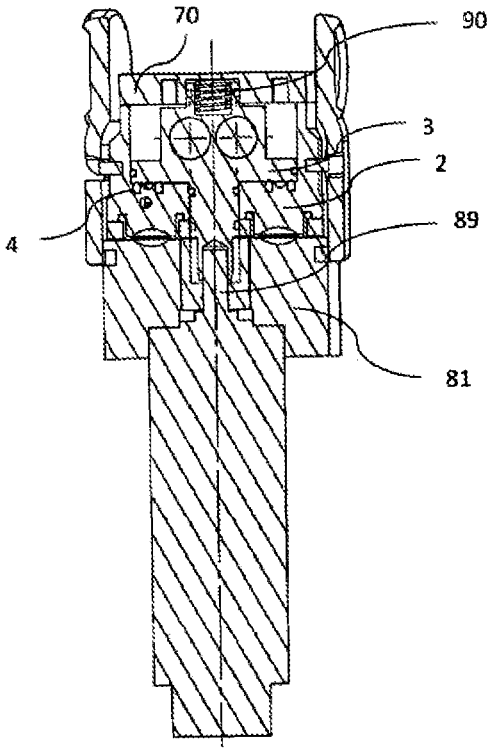

FIG. 29 is a longitudinal section taken along the line C-C according to FIG. 26

Figure 30:
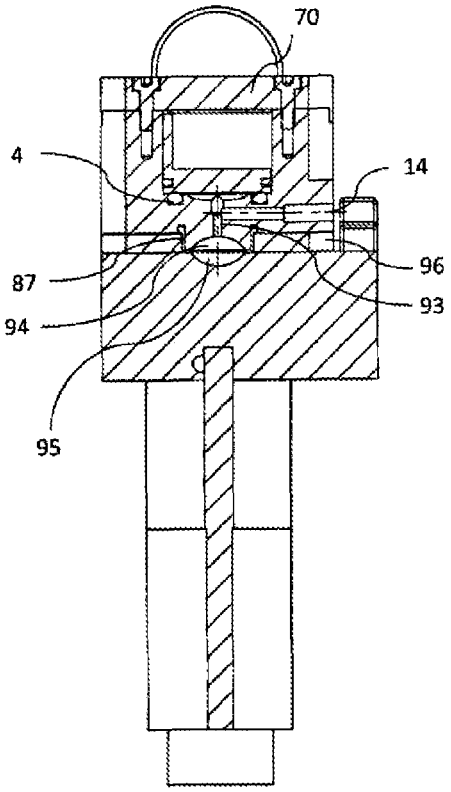

FIG. 30 is a longitudinal section taken along the line D-D according to FIG. 25

Figure 31:
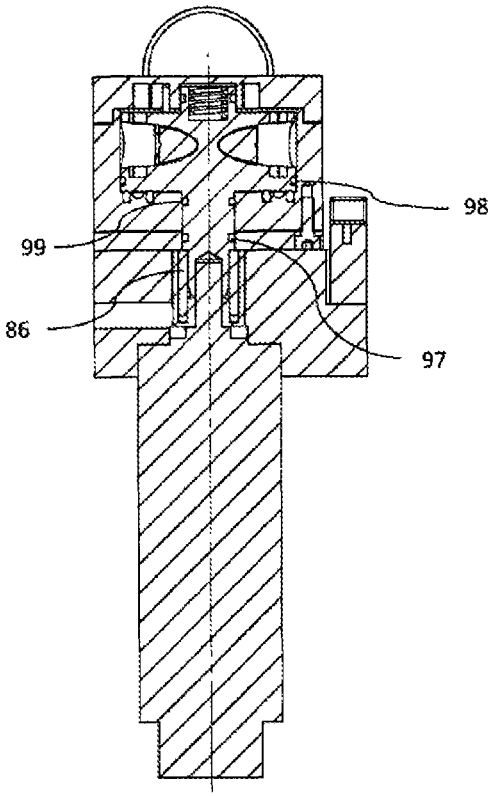

FIG. 31 is a longitudinal section taken along the line E-E according to FIG. 25

Figure 32:
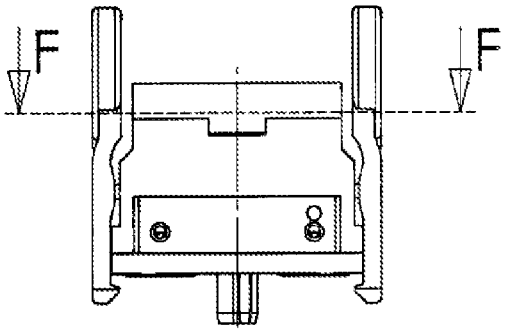

FIG. 32 is a front view of the invention

Figure 33:
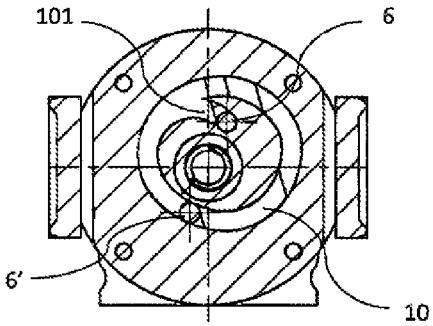

FIG. 33 is a longitudinal section taken along the line F-F according to FIG. 32

Figure 34:
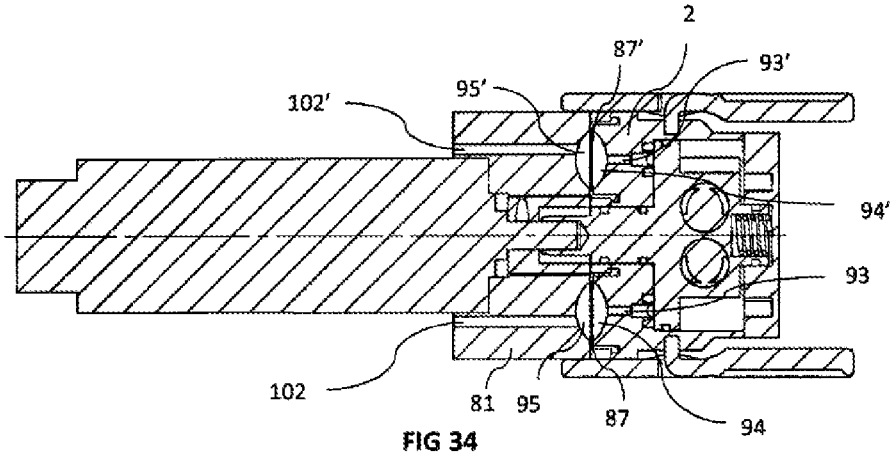

FIG. 34 is a longitudinal section taken along the line G-G according to FIG. 26

Fourth Variant

Figure 35:
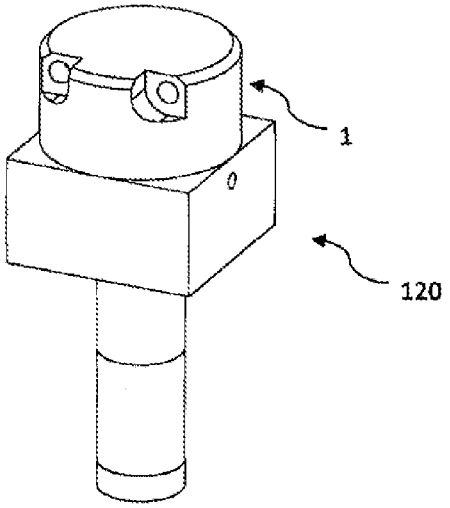
Figure 36:
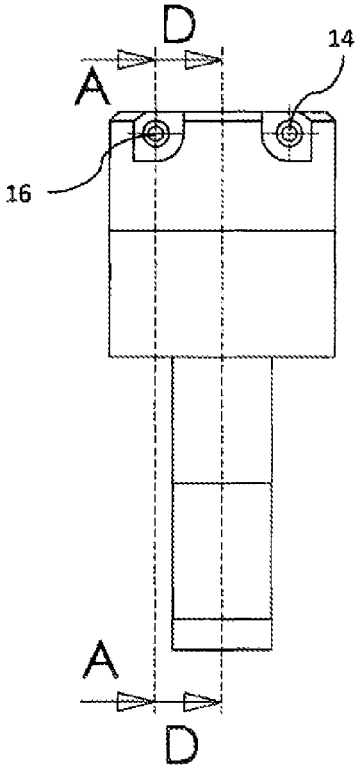
Figure 37:
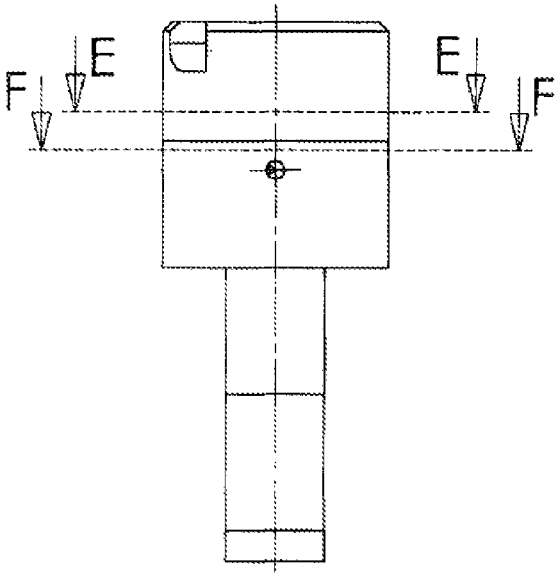
Figure 38:
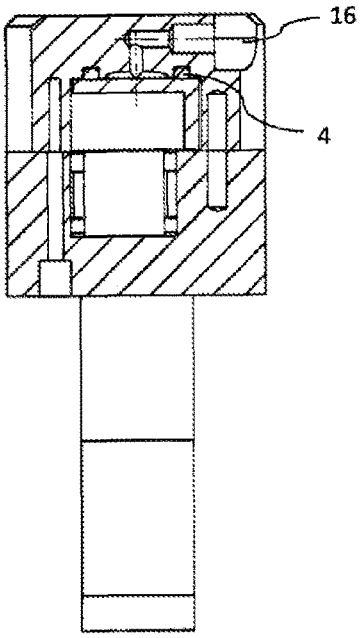

FIG. 35 is a view of an assembly of the fourth variant of the invention with drive arrangement and motor FIG. 36 is a front view of the assembly FIG. 37 is a side view of the assembly FIG. 38 is a longitudinal section taken along the line A-A according to FIG. 36

Figure 39:
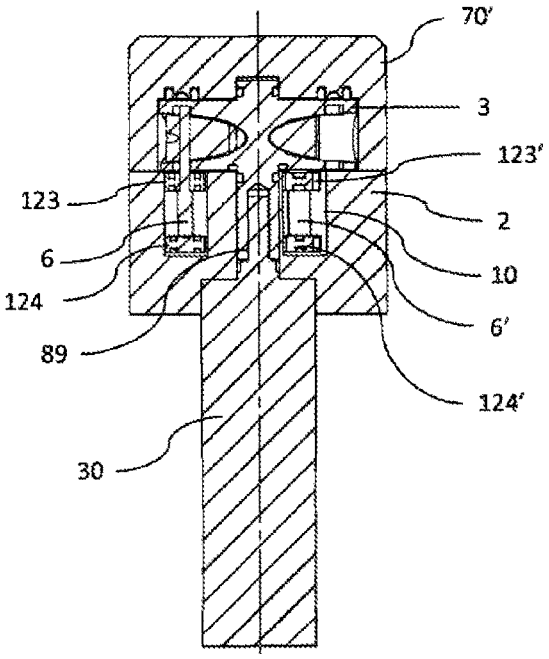

FIG. 39 is a longitudinal section taken along the line D-D according to FIG. 36

Figure 40:
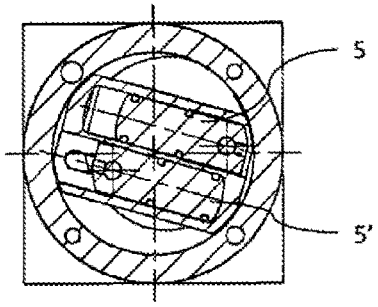

FIG. 40 is a longitudinal section taken along the line E-E according to FIG. 37

Figure 41:
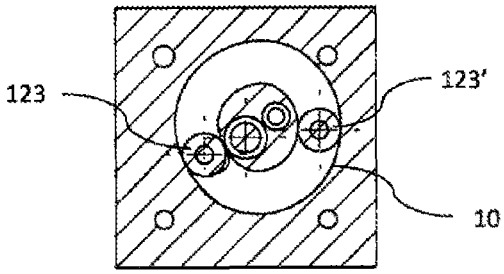

FIG. 41 is a longitudinal section taken along the line F-F according to FIG. 37

Figure 1:
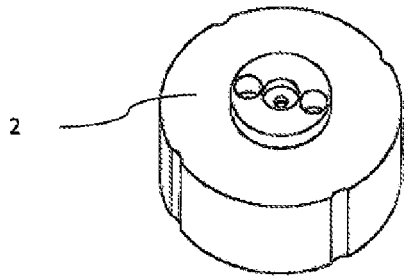
FIG. 1 is a view of one end of the stator
Figure 2:
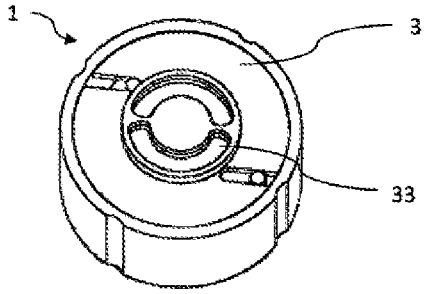
FIG. 2 is a view of the rotor placed inside the other end of the stator
Figure 3:
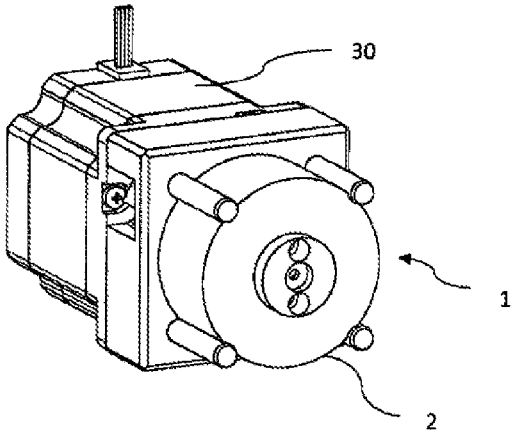
FIG. 3 is a general view of the invention coupled to a motor assembly
Figure 4:
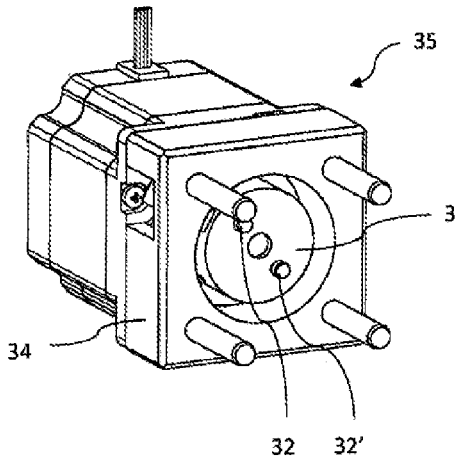
FIG. 4 is a general view of a motor with a support for fixing the invention

According to FIGS. 1 and 2, the pump (1) consists of a stator (2) and a rotor (3) inside the stator (2). According to FIGS. 3 and 4, the pump (1) is coupled to a motor (30), preferably via a drive head (31) and a retaining support (34) intended to receive the stator (2) of the pump (1). Pins (32, 32') on the drive head (31) and locating inside the hollow base (33) of the rotor (3) rotate the rotor (3) of the pump (1) when the latter is coupled to the motor assembly (35).

Figure 5:
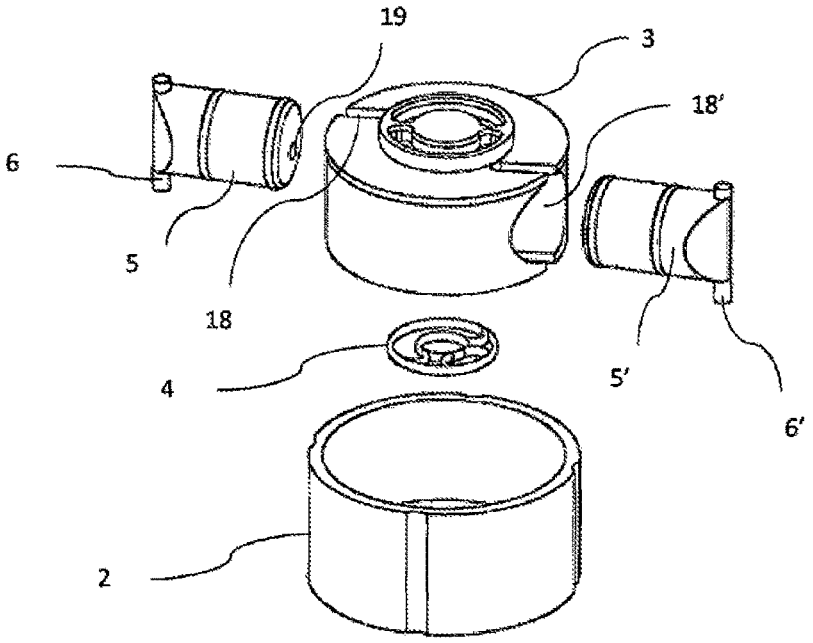
FIG. 5 is an exploded lateral view of the elements constituting the invention
Figure 6:
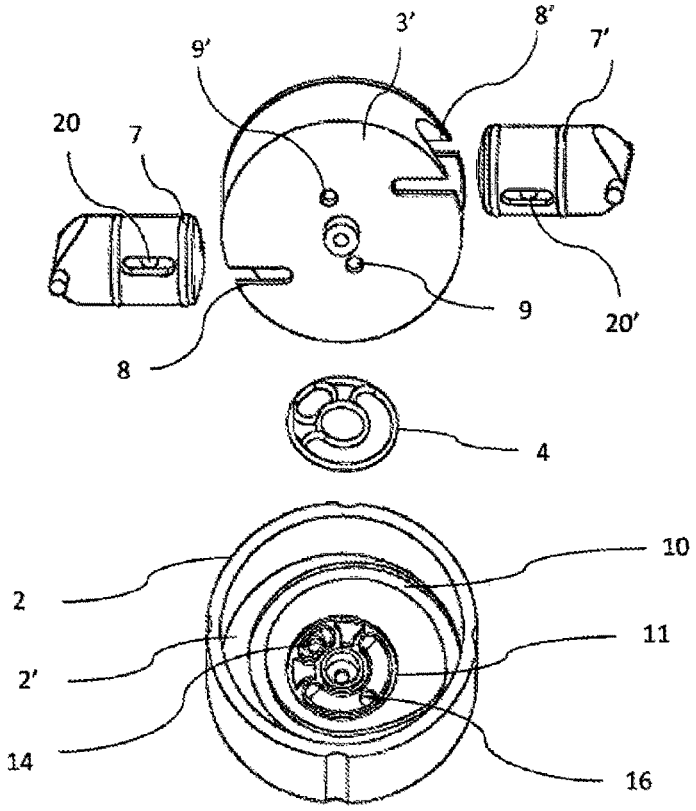
FIG. 6 is an exploded internal view of the elements constituting the invention

According to FIGS. 5 and 6, the stator (2) comprises a cam (10) placed on its interior face (2'), a housing (11) receiving a sealing element (4), an inlet port (14) and an outlet port (16). The rotor (3) comprises two preferably cylindrical, parallel and opposite cavities (18, 18') that are eccentric relative to the rotation axis of the rotor (2) and have respective notches (8,8') at the upper ends of the cavities (18,18') and through-holes (9,9') which form inlet/outlet ports connecting each lower end of the cavities (18,18') with the interior face (3') of the rotor (3). Two preferably identical pistons (5,5') each include two circular seals (7,7'), a front channel (19) on the front face of the piston (5) connected to a lateral channel (20) located between the two circular seals (7,7') and at the lower end a guide element (6) perpendicular to the axis of the piston (5).

Figure 7A:
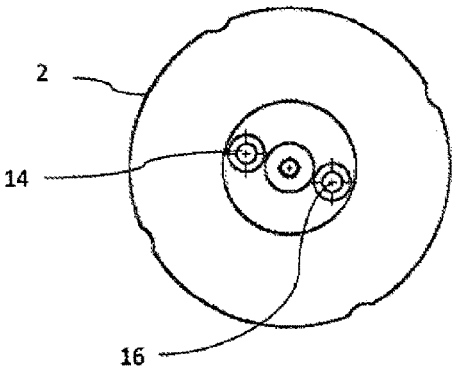
FIG. 7*a* is a view of the front face of the invention
Figure 7B:
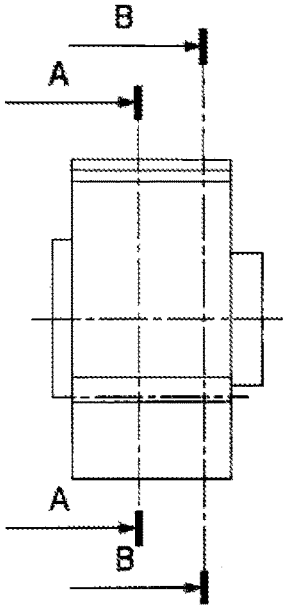
FIG. 7*b* is a side view of the invention
Figure 7C:
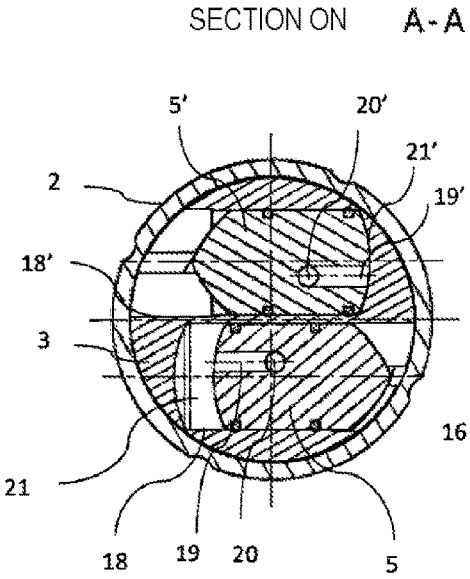
FIG. 7*c* is a longitudinal section taken along the line A-A according to FIG. 7*b*

According to FIG. 7*c*, the pistons (5,5') in the cavities (18,18') of the stator (3) form two respective opposite parallel eccentric pumping chambers (21,21') at 180°.

Figure 7D:
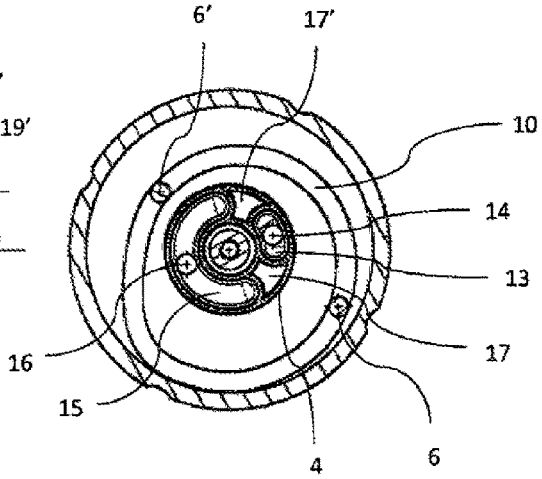
FIG. 7*d* is a longitudinal section taken along the line B-B according to FIG. 7*b*
Figure 14:
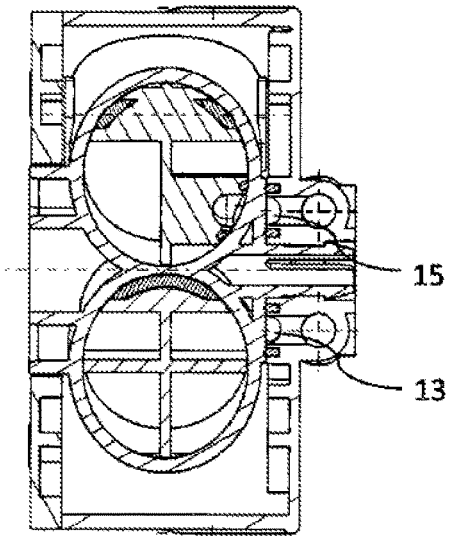
FIG. 14 is a longitudinal section taken along the line B-B according to FIG. 12
Figure 15:
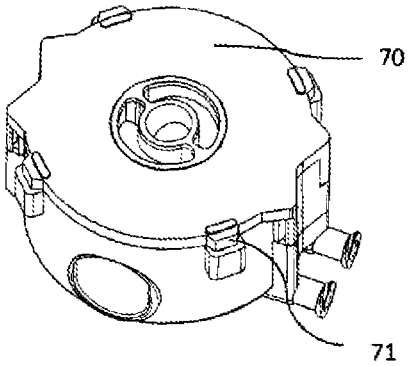
FIG. 15 is a perspective bottom view of the invention

According to FIGS. 7*d* and 14, the inlet cavity (13) connected to the inlet port (14), the outlet cavity (15) connected to the outlet port (16) and the two port changeover transition areas (17,17') located between each side of the cavities (13,15) are positioned on the stator (3) so as to correspond to the phases of filling and draining the chambers (21,21') defined by the cam (10). The guide elements (6,6') of the pistons (5,5') are perpendicular in the cam (10) of the stator (2).

Figure 8:
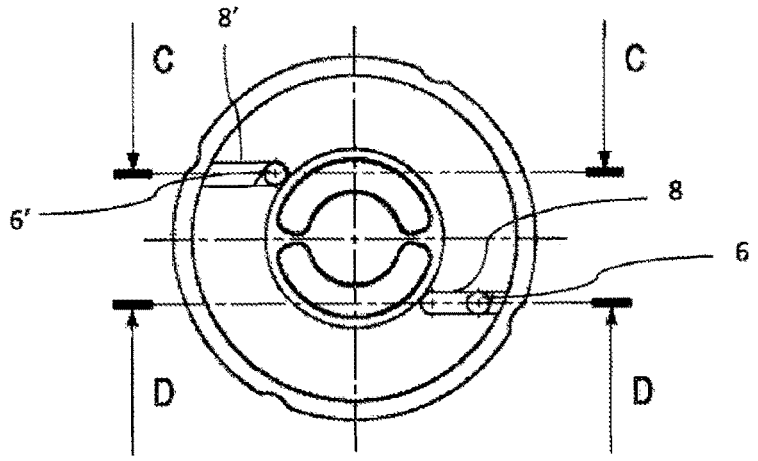
FIG. 8 is a view of the rear face of the invention
Figure 8A:
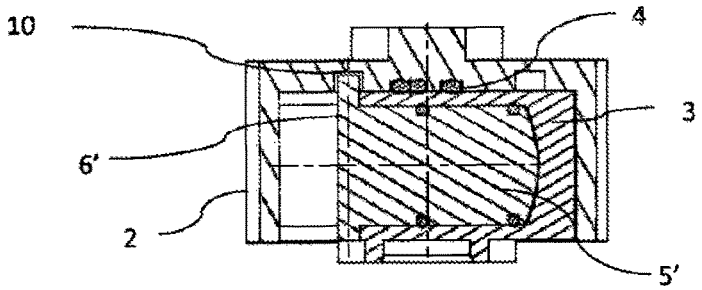
FIG. 8*a* is a longitudinal section taken along the line C-C according to FIG. 8
Figure 8B:
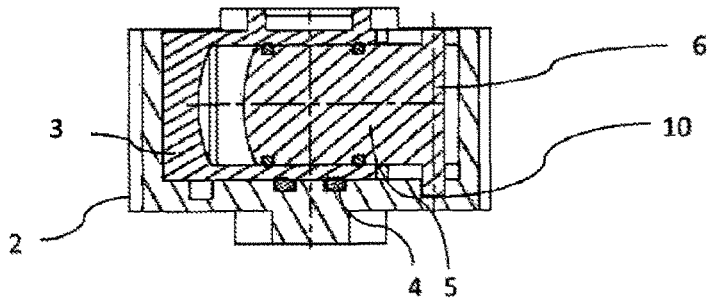
FIG. 8*b* is a longitudinal section taken along the line D-D according to FIG. 8
Figure 9:
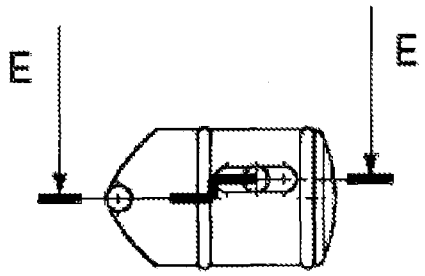
FIG. 9 is a top view of a piston
Figure 9A:
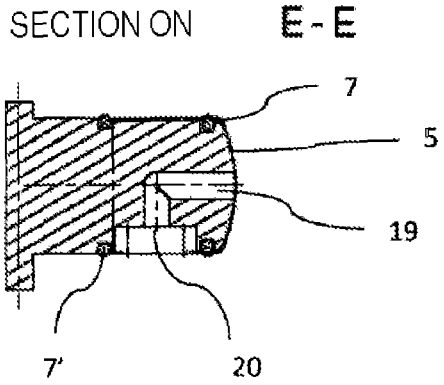
FIG. 9*a* is a longitudinal section taken along the line E-E according to FIG. 9

According to FIG. 8, the guide elements (6,6') are driven and retained by the notches (8,8') of the rotor (3). In FIG. 8*a*, the sealing element (4) is between the stator (2) and the rotor (3).

Figure 10:
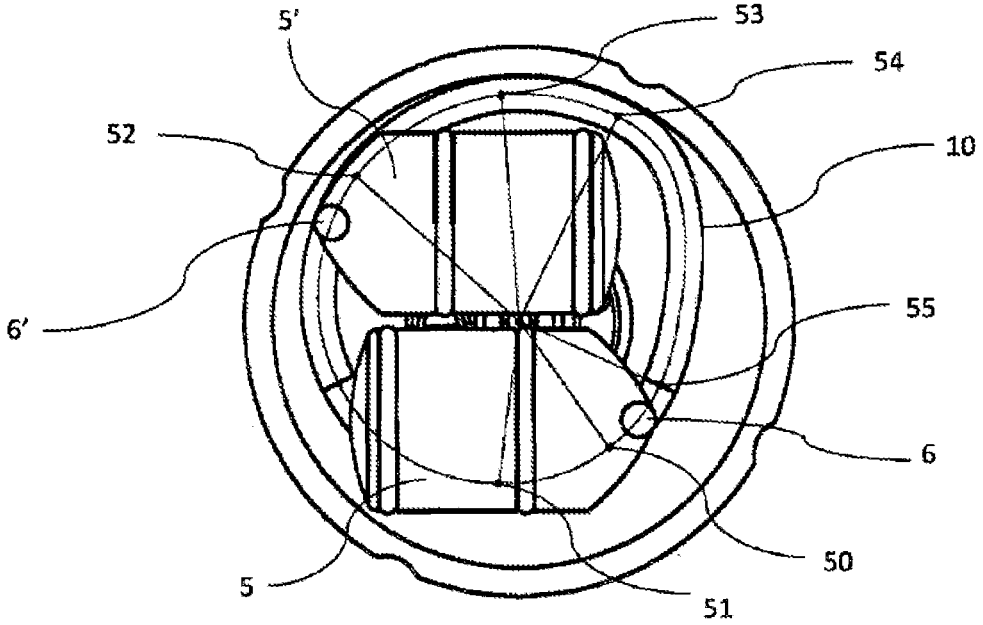
FIG. 10 is a top view of the stator with the pistons and the guide cam
Figure 11:
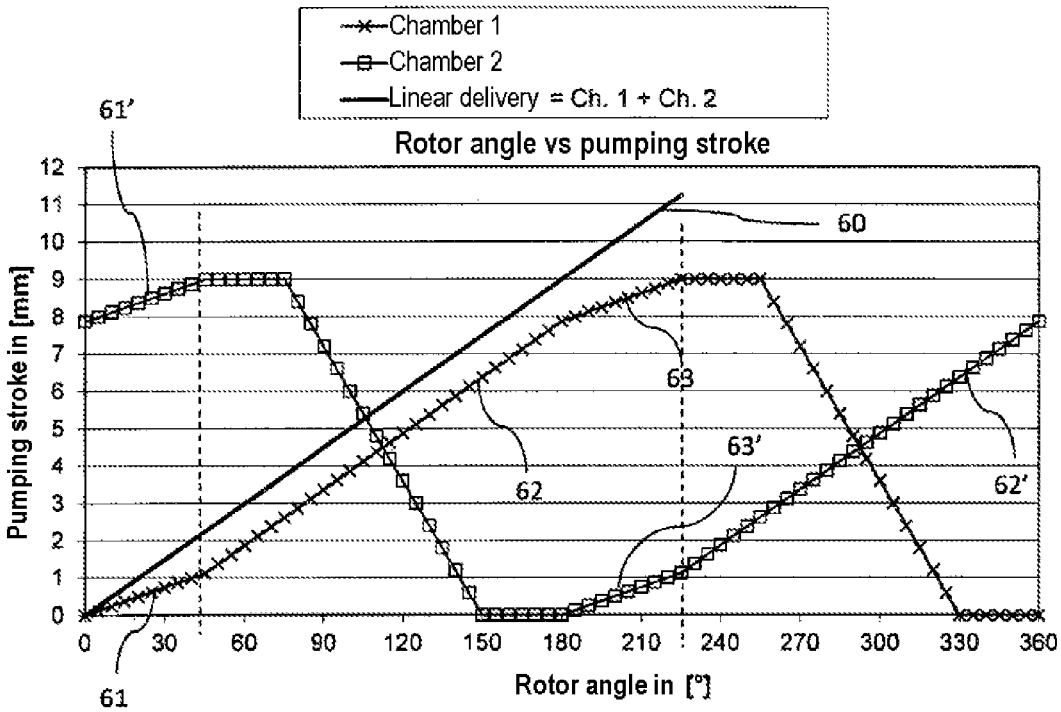
FIG. 11 is a graph of the linear movements of the pistons as a function of the angular displacement of the rotor Second Variant
Figure 12:
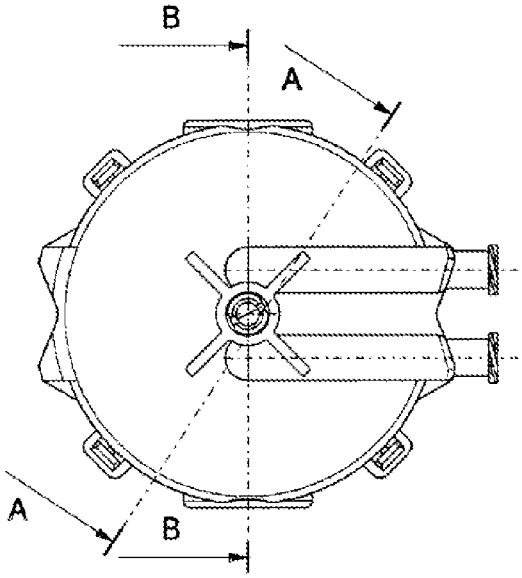
FIG. 12 is a top view of a second variant of the invention

According to FIGS. 10 and 11, the profile of the cam (10) of the stator (2) consists of six segments delimited by the points (50, 51, 52, 53, 54, 55). Each segment of the cam (10) preferably corresponds to a phase of the pumping sequence in the following manner: the phase of starting draining at a low flow rate is effected over the segment between the points (53,52), the phase of draining at the nominal flow rate is effected over the segment between the points (52,51), the phase of ending draining at the low flow rate is effected over the segment between the points (51,50), the phase of changing over from the outlet port (16) to the inlet port (14) is effected over the segment between the points (50,55), the phase of filling is effected over the segment between the points (55, 54) and the phase of changing over from the inlet port (14) to the outlet port (16) is effected over the segment between the points (54,53). Each segment of the cam is preferably dimensioned so as to produce linear movement of the pistons (5,5') so that the nominal flow rate (60) at the outlet of the pump (1) is constant and pulsation-free.

According to FIG. 11 and the preceding figures, the linear movements of the pistons (5,5') correspond to constant flow rates (61,61',62,62',63,63'). The nominal flow rate (60) of the pump (1) as a function of the angle of rotation of the rotor (3) corresponds to the sum of the low flow rates (61, 61') of the pumping chambers (21,21') for a rotation angle preferably between 0 and 45°, to the nominal flow rate (62) of the chamber (21) for an angle preferably between 45° and 180°, to the sum of the low flow rates (63, 63') of the pumping chambers (21,21') for a rotation angle preferably between 180° and 225° and to the nominal flow rate (62') of the chamber (21') for an angle between 225° and 360°.

When the rotor (3) turns from 0° to 45°, the pistons (5, 5') move along the cam at low flow rates (61,61'), the effect of which is to expel the liquid simultaneously from the chambers (21,21') to the outlet port (16) via the front channels (19, 19'), the lateral channels (20,20') of the pistons (5,5') and the through-holes (9,9') connected to the outlet cavity (15).

When the rotor (3) turns from 45° to 75°, the piston (5) continues to expel the liquid from the chamber (21) at the nominal flow rate (62). The piston (5') ceases to move in a linear manner and the lateral channel (20') is connected via the through-hole (9') to the port changeover transition area (17'), which closes the chamber (21'). When the rotor (3) turns preferably from 75° to 150°, the piston (5) continues to expel the liquid from the chamber (21) at the nominal flow rate (62). The piston (5') moves in a linear manner in the opposite direction, the effect of which is to aspirate the liquid in the chamber (21') from the inlet port (14) via the front channel (19'), the lateral channel (20') and the through-hole (9') connected to the inlet cavity (13).

When the rotor (3) turns preferably from 150° to 180°, the piston (5) continues to expel the liquid from the chamber (21) at the nominal flow rate (62). The piston (5') ceases to move in a linear manner and the lateral channel (20') is connected via the through-hole (9') to the port changeover transition area (17), which closes the chamber (21').

When the rotor (3) turns preferably from 180° to 225°, the pistons (5, 5') move along the cam at low flow rates (63,63'), the effect of which is to expel the liquid simultaneously from the chambers (21,21') to the outlet port (16) via the front channels (19, 19'), the lateral channels (20,20') of the pistons (5,5') and the through-holes (9,9') connected to the outlet cavity (15).

When the rotor (3) turns from 225° to 255°, the piston (5') continues to expel the liquid from the chamber (21') at the nominal flow rate (62'). The piston (5) ceases to move in a linear manner and the lateral channel (20) is connected via the through-hole (9) to the port changeover transition area (17'), which closes the chamber (21).

When the rotor (3) turns from 255° to 330°, the piston (5') continues to expel the liquid from the chamber (21') at the nominal flow rate (62'). The piston (5) moves in a linear manner in the opposite direction, the effect of which is to aspirate the liquid in the chamber (21) from the inlet port (14) via the front channel (19), the lateral channel (20) and the through-hole (9) connected to the inlet cavity (13).

When the rotor (3) turns preferably from 330° to 360°, the piston (5') continues to expel the liquid from the chamber (21') at the nominal flow rate (62'). The piston (5) ceases to move in a linear manner and the lateral channel (20) is connected via the through-hole (9) to the port changeover transition area (17), which closes the chamber (21).

When the rotor (3) is turned 360° relative to the stator (2) it returns to the 0° position, which corresponds to a complete pumping cycle of the pump (1).

Description of a Second Variant of the Invention

Figure 13:
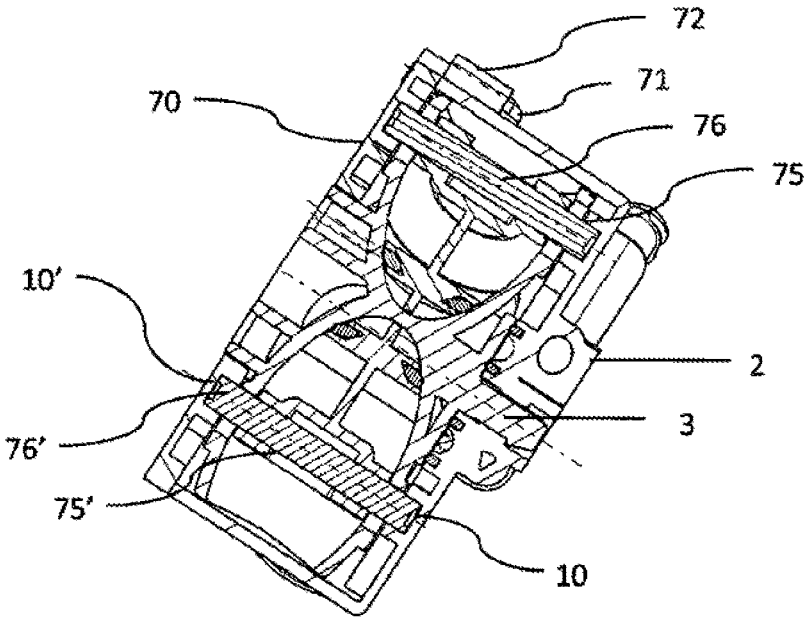
FIG. 13 is a longitudinal section taken along the line A-A according to FIG. 12
Figure 17:
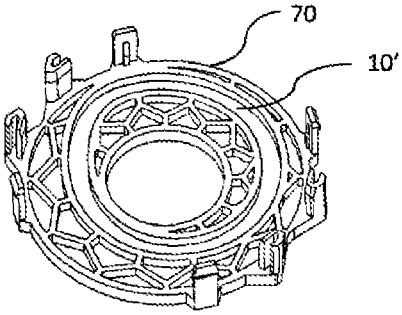
FIG. 17 is an interior view of the cap of the invention
Figure 18:
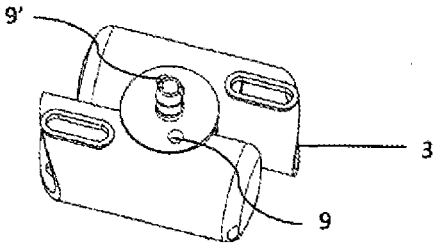
FIG. 18 is a view of the rotor of the invention
Figure 19:
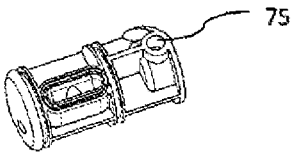
FIG. 19 is a view of a piston of the invention
Figure 20:
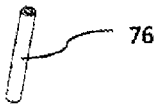
FIG. 20 is a view of a guide element of the invention

According to FIGS. 13 and 17, a cap (70) is placed opposite the stator (2) so as to retain the rotor (3) between the cap (70) and the stator (2). The cap (70) is preferably retained on the stator (2) with the aid of at least one clip (71) and an attachment (72). The cap can therefore clamp the rotor (3) in the stator (2). In a variant, not shown, the cap (70) provides pre-clamping and clamping is provided in operation by an external locking element coming to bear on the cap (70) and the stator (2).

Guide elements (76,76'), preferably in the form of pins, are placed inside the holes (75,75') in the pistons (5,5') so as to guide the pistons (5,5') along the cam (10) of the stator (2) and the cam (10'), which is symmetrical with respect to the cam (10), on the interior face of the cap (70). The ends of the guide elements (76,76') are therefore guided perfectly in a symmetrical manner making the movements of the pistons (5,5') more effective and ensuring improved resistance to forces when the pump turns at a high speed or delivers at a high pressure. The guide elements (76,76') turn freely inside the holes (75,75') of the pistons (5,5') so as to reduce the friction with the cam (10) and the cam (10').

Figure 16:
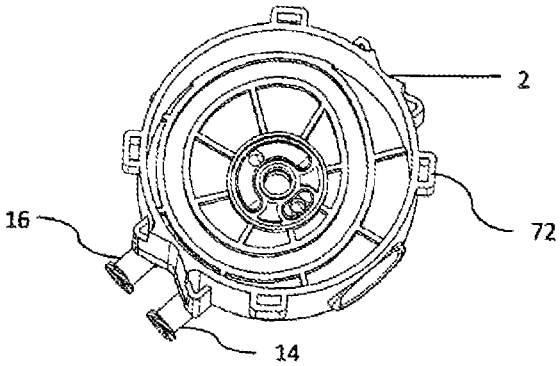
FIG. 16 is an interior view of the stator of the invention

According to FIG. 16, the inlet and outlet ports (14,16) are optionally perpendicular to the rotation axis of the rotor (3).

Description of a Third Variant of the Invention

According to FIGS. 21, 22 and 26, the assembly (80) is made up of a motor (30) fixed to a support (81) receiving the pump (1) retained on the support (81) by fixing elements (82,82') preferably in the form of clips. The support (81) is adapted to receive at least one air or pressure sensor (83) preferably fixed close to the inlet port (14) or the outlet port (16). The sensor (83) enables a tube (85) to be received in the housing (84) in order to detect air bubbles or to measure the pressure at the inlet (14) or at the outlet (16) of the pump (1). The fixing elements (82,82') may be an integral part of the pump (1), the support (81) or a combination of the two. The rotor (3) is driven by the motor shaft (89).

According to FIGS. 7*d*, 23, 28, 29 and 31, the rotor (3) is held so that it bears against the sealing element (4) with the aid of at least one return element (90), such as a return spring for example or any other return means, when the pump (1) is not connected to the support (81) and can be moved axially toward the return element (90) by pressing on the lower end (86) of the rotor (3). During the axial movement, the rotor (3) is no longer in contact with the sealing element (4), which creates a channel or controlled leak (not shown) between the cavities (13,15) enabling direct connection of the inlet and outlet ports (14,16). The seal with respect to the exterior is provided by the sealing elements (98) and (99). This function is particularly suitable in procedures necessitating circulation of the fluid through the pump (1) and the inlet and outlet tubes (not shown) connected to the inlet and outlet ports (14,16) without the aid of an external drive arrangement. This type of procedure is commonly used in a hospital environment when a pump is operated to purge by gravity air contained in the tubes or pipes connected to the pump (1) before connecting it to the drive head (31) or the support (81). Similarly, it may be necessary to purge the fluid contained in the tubes or pipes after using the pump or when the drive arrangement is inoperative. The optional seal (97) makes it possible to improve the guidance of the rotor.

The return element (90) may be adapted so that the function is reversed and the rotor (3) must be drawn toward the direction opposite to the return element (90) to bear on the sealing element (4).

According to FIGS. 7*c*, 7*d* and 33, the cam (10) is adapted to be able to position a guide element (6 or 6') in a groove (101) preferably located inside the cam (10). When a guide element (6 or 6') is placed at the bottom of the groove (101) the associated piston (5 or 5') is held in a high position in the pumping chamber (21 or 21') in order to minimize the volume. By also placing the other guide element (6' or 6) in a high position on the cam (10), the second pumping chamber (21' or 21) is maintained at the minimum volume. It is then possible to purge completely the fluid, for example the air, contained in the internal pipes of the inlet and outlet ports (14,16) and the cavities (13,15) and changeover transition areas (17,17') by pushing or pulling on the lower end (86) of the rotor (3), as explained above. This function is particularly suitable when it is necessary to purge the fluid in the pump completely before or after it is used. If the two chambers are not drained completely by placing the pistons (5,5') in the high position the residual fluid contained in the chambers (21,21') may prove hazardous, for example during an intravenous transfusion if air that has not been purged causes an embolism.

According to FIGS. 23, 30, 31 and 34, the stator (2) is adapted to receive two flexible elements (87,87'), preferably in the form of silicone or elastomer membranes, respectively connected to the inlet and outlet ports (14,16) and the pumping chambers (21,21') via the channels (93 and 93'). Each channel (93,93') is connected at its other end to the cavities (94,94'), respectively, located between the stator (2) and the flexible elements (87,87'). When the pump (1) is fixed to the support (81), each flexible element (87,87') forms with the support (81) two cavities (95,95') each having a respective connecting channel (102, 102') placed in the support (81).

During operation of the pump (1), pressure variations occurring in the pumping chambers (21,21') deform the respective flexible elements (87,87'), which transmit the pressure from each cavity (94,94') to the cavities (95,95'), respectively. It is then possible to measure the pressure at the inlet and at the outlet of the pump by placing two pressure sensors (not shown) at the exterior ends of the channels (102,102'). The flexible elements (87,87') provide the isolation and the seal between the internal fluidic circuit of the pump and the exterior, as well as making it possible to measure pressure variations occurring at the inlet and at the outlet of the pump. This system is particularly suitable for measuring leaks or detecting blockages at the inlet or at the outlet of the pump without having to connect pressure gauges to the external tubes of the pump. Integrating the flexible elements (87,87') into the pump (1) makes it possible to reduce the overall size of the system, which is extremely important in portable pumps, for example, notably in the medical field.

Description of a Fourth Variant of the Invention

According to FIGS. 35, 38 and 39, the assembly (120) comprises a motor (30) fixed to a support (81) receiving the stator (2). The rotor (3) is positioned inside the stator (2) so that the sealing element (4) is held between the rotor (3) and the stator (2). The cam (10) located inside the support (81) is adapted to receive at least one pair of bearings (123, 123') fixed to the respective guide elements (6,6') in order to reduce friction and wear of the cam (10) and the guide elements (6,6'). A second pair of bearings (124,124') fixed to the respective guide elements (6,6') enables reinforcement of the alignment of the guide elements (6,6') when it is necessary to deliver very accurate doses of fluids and to produce as perfectly as possible a linear flow rate. The rotor (3) can optionally be guided in the stator (2) and the support (81) by bearings.

The pumping principle described above is reversible by having the rotor turn in the other direction.

The angle values defined above are given by way of example and may be different according to the dimensions of the cam or the required flow rate curve.

The low flow rates (61,61',63, 63') are preferably equivalent to half the nominal flow rate of the pump.

The cam may be adapted to produce a pulsed or semi-pulsed flow.

In another variant, not shown, the housing (11) and the sealing element (4) may be on the interior face of the rotor (3).

In another variant, not shown, the cavities (13,15) and the changeover transition areas (17,17') may be perpendicular to the rotation axis of the pump. In this case, the sealing element is preferably at the periphery of the rotor of the pump.

In another variant, not shown, the rotor may be adapted to receive a magnetic element so that it can be driven in rotation with the aid of a magnet or any other exterior electromagnetic element. Thus the pump may be coupled to a contactless drive arrangement. This variant is particularly suitable if the pump is implanted under the skin or in the body and must be actuated from the outside.

In another variant, not shown, the cap may be adapted to receive the inlet and outlet ports of the pump.

The seal between the mobile parts is preferably produced by means of an elastomer, an overmolded seal or any other sealing element. However, it is possible to produce the pump with no sealing element between the stator or the cap and the rotor, for example by virtue of the fit between them. The elements constituting the pump are preferably made of plastic and disposable. The pump may be sterilized for the distribution of food or medication for example. The choice of materials is not limited to plastics, however.

Although the invention has been described with reference to a plurality of embodiments, there exist other variants that are not described. The scope of the invention is therefore not limited to the embodiments described above.

The invention claimed is:

1. A pump comprising:

two pistons in a rotor, the rotor being located inside two cavities forming a stator and being rotatable about an axis in contact with the stator, the rotor forming two opposite parallel pumping chambers in which the pistons respectively translate, driven by a fixed cam located inside the stator, the rotor having port for each pumping chamber through which a fluid can be aspirated into each of the pumping chambers during a filling movement of one of the pistons within the chamber and then expelled from each of the pumping chambers, during a pumping movement of one of the pistons within the chamber, through the port for each pumping chamber, wherein the stator comprises a housing portion defining an inlet cavity alternatively connected by rotation of the rotor, synchronously with the piston pumping movements, to the port of each of the pumping chambers, an outlet cavity alternatively connected to the port of each of the pumping chambers, and two ports changeover transition areas located between the inlet and outlet cavities, the inlet and outlet cavities with their respective external port changeover transition areas located there between being arranged around the rotor axis.

2. The pump as claimed in claim 1, wherein the outlet flow of fluid is continuous and pulsation-free when the rotor is rotated relative to the stator.

3. The pump as claimed in claim 1, wherein the pistons of which include guide elements placed perpendicularly in the fixed cam on the interior face of the stator.

4. The pump as claimed in claim 3, wherein the guide elements of which are driven and retained by the notches of the rotor.

5. The pump as claimed in claim 1, wherein the pistons each include a front channel connected to a lateral channel which communicates with the respective port of the rotor.

6. The pump as claimed in claim 1, wherein including a sealing element between the stator housing portion and the rotor.

7. The pump as claimed in claim 1, wherein the sum of fluid expelled from each of the pumping chambers provides a nominal fluid flow rate of the pump.

8. The pump as claimed in claim 1, wherein the two pumping chambers of which simultaneously expel to the outlet cavity during the partial rotation of the rotor.

9. The pump as claimed in claim 1, further comprising including a cap opposite the stator housing portion with the rotor oriented there between.

10. The pump as claimed in claim 9, wherein the cap of which has on the interior face a cam symmetrical with respect to the fixed cam.

11. The pump as claimed in claim 1, wherein the profile of the fixed cam is composed of six segments.

12. The pump as claimed in claim 1, further comprising a seal between the mobile parts of which is produced with at least one elastomer.

13. The pump as claimed in claim 1, wherein the pistons, rotor and stator are made of plastic and disposable.

14. The pump as claimed in claim 1, having at least one flexible element connected to the inlet or outlet port.

15. The pump as claimed in claim 1, the rotor of which can be moved axially.

* * * * *